United States Patent [19]

Teruo et al.

[11] Patent Number: 4,470,752

[45] Date of Patent: Sep. 11, 1984

[54] PUMP FOR SUPPLYING LIQUID FUEL

[75] Inventors: Maruyama Teruo, Osaka; Oshima Hiroo, Nara; Iwai Fumio; Abe Yoshikazu, both of Osaka, all of Japan

[73] Assignee: Matsushita Electric Industrial Co., Ltd., Osaka, Japan

[21] Appl. No.: 559,831

[22] PCT Filed: May 14, 1981

[86] PCT No.: PCT/JP81/00110

§ 371 Date: Jan. 11, 1982

§ 102(e) Date: Jan. 11, 1982

[87] PCT Pub. No.: WO81/03363

PCT Pub. Date: Nov. 26, 1981

Related U.S. Application Data

[63] Continuation of Ser. No. 339,442, Jan. 11, 1982, abandoned.

[30] Foreign Application Priority Data

May 16, 1980 [JP] Japan ..... 55-65531

[51] Int. Cl.[3] ..... F01D 5/00; F01D 11/00

[52] U.S. Cl. ..... 415/72; 415/143; 415/169 A

[58] Field of Search ..... 415/71-74, 415/169 A, 170 B, 143, 90, 99; 417/410; 366/279

[56] References Cited

U.S. PATENT DOCUMENTS

| | | | |
|---|---|---|---|
| 268,606 | 12/1882 | Barbour et al. | 415/72 UX |
| 3,171,356 | 3/1965 | Pensabene | 417/410 |
| 3,643,516 | 2/1972 | Jacobson | 415/90 X |
| 3,870,433 | 3/1975 | Raikov et al. | 415/72 |

*Primary Examiner*—Stephen Marcus
*Assistant Examiner*—Joseph M. Pitko
*Attorney, Agent, or Firm*—Joseph W. Farley

[57] ABSTRACT

This invention relates to a liquid fuel supply pump which has a pattern of shallow grooves 14 formed on at least one of the opposed surfaces of a stationary member 2 and a rotary member 1 to forcibly send liquid fuel 17 forward by the groove pattern 14. A fluid bearing is formed for the rotary member 1 by the liquid fuel 17 flowing through a clearance between the stationary member 2 and the rotary member 1, and the clearance is made not larger than 20 microns, whereby the liquid fuel supply pump is adapted to supply the liquid fuel 17 to a liquid fuel combustion apparatus stably at an exceedingly low flow rate.

10 Claims, 12 Drawing Figures

PUMP FOR SUPPLYING LIQUID FUEL

TECHNICAL FIELD

The present invention relates to a pump for supplying liquid fuel which is useful for liquid fuel combustion apparatus and which has stable pressure-flow rate characteristics and is capable of supplying liquid fuel to such a combustion apparatus stably at a very small rate.

BACKGROUND ART

Liquid fuel supply pumps useful for liquid fuel combustion apparatus generally comprise a cylinder B disposed in a solenoid A and a plunger C supported within the cylinder B by an upper spring D and a lower spring E and movable upward and downward, as shown in FIG. 1.

A power supply of modulated pulse width is connected to the solenoid A to intermittently drive the plunger C up and down and supply liquid fuel to a liquid fuel combustion apparatus at a rate of about 5 cc to 8 cc/min.

However, with the wide use of space heaters, it has been strongly desired in recent years to give a variable heat output over a wider range than heretofore possible for more delicately controlled comfortable space heating or for savings in energy.

However, when giving a heat output which is variable, for example, from 3500 Kcal/h to 1000 Kcal/h, the supply of liquid fuel by the pump shown in FIG. 1, which is 5 cc to 8 cc/min, must be reduced to not larger than $\frac{1}{3}$ the amount, i.e. 1 to 3 cc/min. To give a still smaller heat output, the supply must be reduced further.

Nevertheless, when for example obtaining a heat output of 3500 Kcal/h by driving the plunger C at a pulse frequency of 10 Hz, the plunger output per stroke must be $$\frac{7\ \text{cc/min}}{10} = \frac{0.12\ \text{cc/sec}}{10} = 0.012\ \text{cc.}$$

Since the flow rate of the pump of FIG. 1 is limited to the range of 5 cc/min in view of accuracy, it is impossible to obtain the above variable range of low heat outputs.

Further gear pumps involve a lower limit of as much as 30 cc/min due to the leakage of the fluid through the gear-to-gear clearance. The gear pump thus also fails to give the above variable range of low heat output.

DISCLOSURE OF INVENTION

Accordingly the object of the invention is to make it possible to supply liquid fuel to liquid fuel combustion apparatus stably at an exceedingly reduced rate.

An embodiment of the present invention will be described below with reference to the accompanying drawings.

BEST MODE OF CARRYING OUT THE INVENTION

Figure 2:
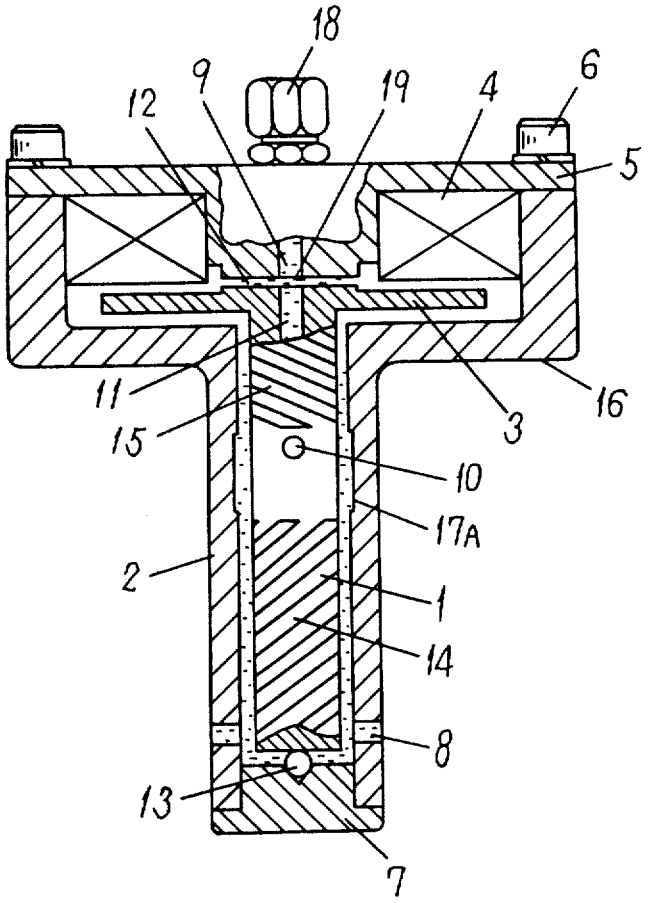
FIG. 2 is a sectional view of a liquid fuel supply pump according to an embodiment of the invention.

With reference to FIG. 2, a cylindrical rotary shaft 1 which is a rotary member is rotatably housed in a hollow cylindrical housing 2 which is a stationary member. A rotor 3 for a motor fixed to the rotary shaft 1 is opposed to a stator 4. The stator 4 is accommodated in a case 5. The case 5 is fastened to the housing by bolts 6. On the other hand, the housing 2 has a lower cover 7 attached to its lower end. The housing 2 further has at a lower portion thereof inlet bores 8 extending through its side wall. The case 5 has an outlet bore 9 extending centrally therethrough. The rotary shaft 1 has a port 10 in its outer peripheral portion. An axial flow channel 11 extending from the upper end of the rotary shaft 1 coaxially therewith is in communication with the port 10.

Upper spiral grooves 12 are formed in the upper end of the shaft 1 to provide a thrust fluid bearing. A spherical pivot bearing 13 is provided between the lower end of the shaft 1 and the lower cover 7 opposed thereto. The rotary shaft 1 has pumping spiral grooves 14 in the outer surface of its lower portion and lower seal grooves 15 at its upper portion.

Figure 3:
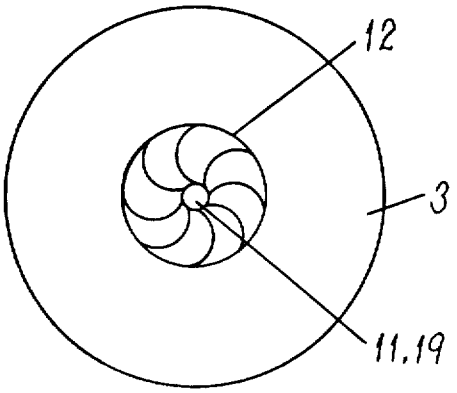
FIG. 3 is a plan view of a rotor in FIG. 2.

FIG. 3 shows the shape of the upper spiral grooves 12. The spiral grooves (furrows) and ridges are arranged symmetrically along the circumference. (The drawing shows the grooves as solid black portions.)

With reference to FIG. 2 again, a diametrically enlarged portion 17A is formed in the inner surface of the housing 2 circumferentially thereof in the vicinity of the port 10 of the rotary shaft 1. A pipe joint 18 for supplying kerosene is provided in communication with the outlet bore 9. The housing 2 has on the bottom side an attaching surface 16 for attaching the pump of FIG. 2, for example, to a kerosene tank.

The rotary shaft 1 and the rotor 3 provide the rotary assembly of the present device, while the housing 2, the stator 4, the case 5 and the lower cover 7 provide the stationary assembly thereof.

Further the stator 4 (primary element, coil) and the rotor 3 (secondary element, conductor) are arranged face-to-face to consitute a rotation induction motor.

The rotary magnetic field set up by the stator 4 generates an eddy current on the surface of the rotor 3, and the product of the magnetic field and the eddy current through the rotor 3 produces continuous thrust (torque) based on Fleming's rule of left hand. While electromagnetic induction further produces an axial vertical force between the rotor 3 in rotation and the stator 4, this vertical force of the motor and the fluid pressure produced by the upper spiral grooves 12 of the rotor 3 come into balance with a vertical counteracting force from the pivot bearing 13, whereby the movable assembly is restrained axially.

Figure 4:
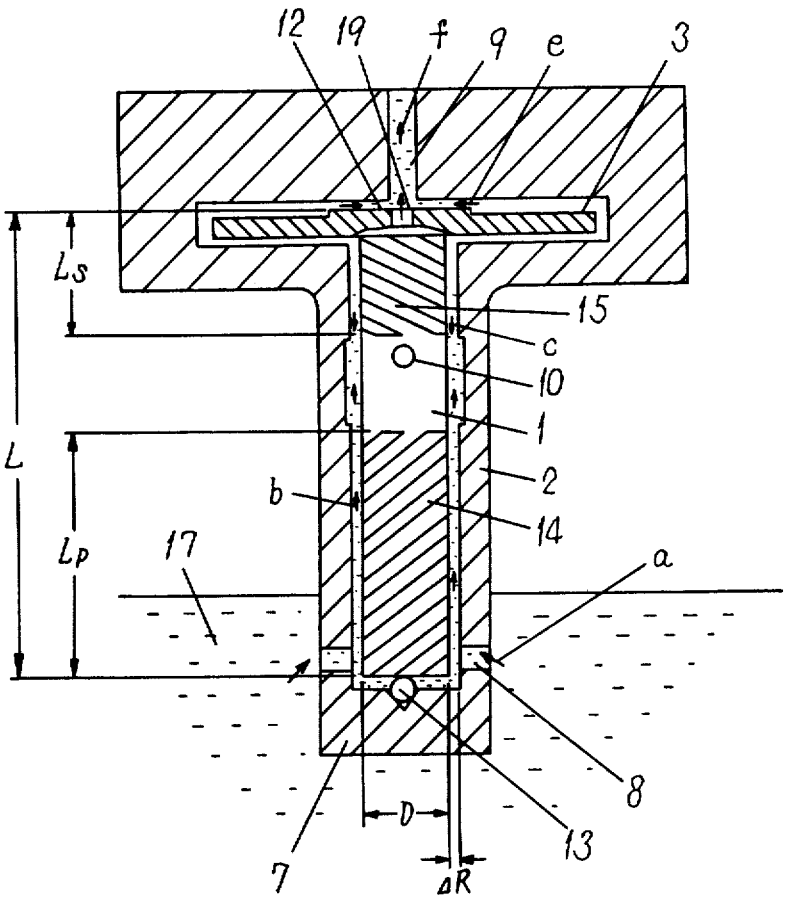
FIG. 4 is a sectional view showing the flow of kerosene.

FIG. 4 is a diagram showing the flow of kerosene when the pump is driven as immersed in a kerosene tank. When the rotary shaft 1 and the housing 2 rotate relative to each other, the pumping spiral grooves 14 act to supply the kerosene 17 used as an example of liquid fuel, drawing the kerosene into the pump through the inlet bores 8 as indicated by an arrow a.

When the kerosene 17 rises to the level of the port 10 as indicated by an arrow b, the kerosene is forced backward as indicated by an arrow c by the lower seal grooves 15 which act in a direction opposite to the direction of the pumping action of the spiral grooves 14. Consequently the kerosene 17 flows solely into the port 10. Subsequently the kerosene passes through the axial flow channel 11 along the axis of the rotary shaft 1 and flows out from an opening 19 at the upper shaft end, where the kerosene 17 is prevented from flowing radially outward by the upper spiral grooves 12 which produce a pumping action as indicated by an arrow e. Accordingly the kerosene 17 flows only into the outlet bore 9 formed in the center of the case 5, passes through a pipe (not shown) connected to the pump as indicated by an arrow f and is fed to a liquid fuel combustion apparatus.

Figure 5:
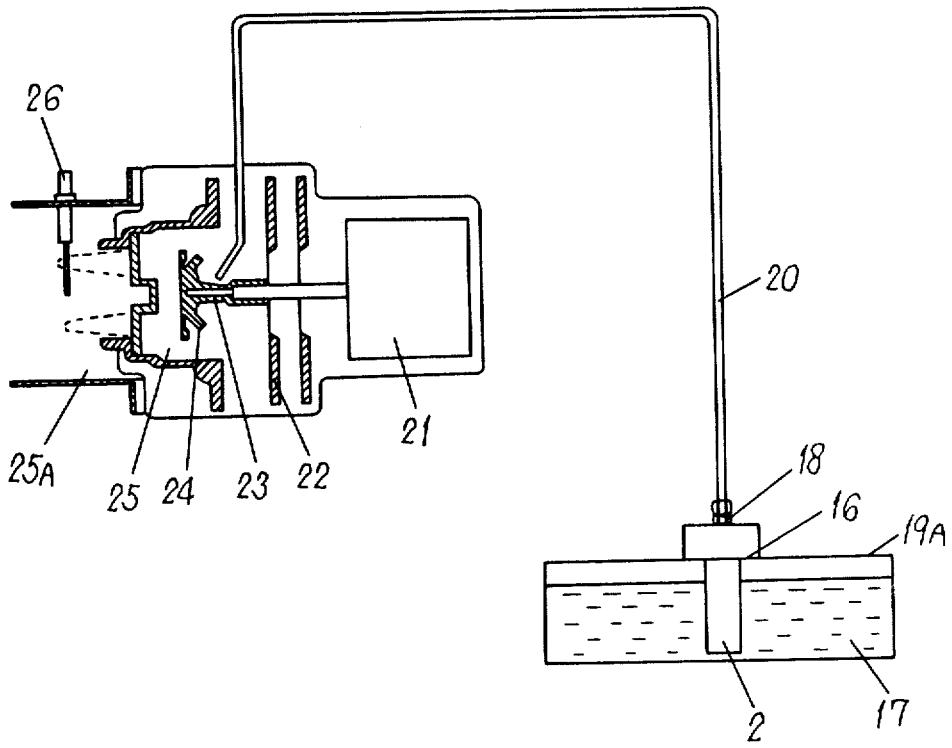
FIG. 5 is a diagram showing the arrangement of a rotary gasifying burner and the ump of FIG. 2 as used therefor.

FIG. 5 shows a rotary gasifying burner as an example of such apparatus and the present pump as used for the burner. A kerosene tank 19A is provided at an upper portion thereof with the pump shown in FIGS. 2 to 4.

A pipe 20 connected to the pipe joint 18 for supplying kerosene 17 to a vaporizing chamber 25 is opposed to a rotor 23 which is coupled to a burner motor 21 along with a turbofan 22. The rotor 23 is integral with an agitator plate 24 and is disposed within the vaporizing chamber 25. A combustion chamber 25A is provided with a flame rod 26.

In FIG. 5, the conical rotor 23 is driven by the burner motor 21 to feed the kerosene 17 dropwise from the pipe 20 at a constant rate. The kerosene 17 supplied dropwise is centrifugally spread over the tapered surface of the rotor 23, further forced outward circumferentially thereof and reduced to minute particles by the agitator plate 24. The kerosene in the form of minute particles is gasified within a vaporizing chamber 25 heated by a heater (not shown).

Next, the features of the present pump will be described in detail.

Pumps of the friction type having a screw-shaped groove element are usually used for supplying highly viscous materials and lubricants for internal combustion engines.

However, these grooved pumps have grooves of large dimensions for transporting fluids having a high viscosity in large amounts.

Whereas the grooves of the conventional grooved pump are made chiefly by machining in large dimensions, the present pump which is intended to supply liquid fuel, especially kerosene, has the feature that the pattern of shallow grooves for pumping kerosene having a very low viscosity can be formed advantageously by a chemical process, such as etching or plating.

The present pump differs greatly from conventional grooved pumps in the following characteristics.

(1) The pump gives an exceedingly low flow rate.

(2) It is less affected by variations in load and assures a stable supply.

According to the present embodiment, the pump is used at a very small rate Q of more than 0.1 cc/min but less than 25 cc/min if highest, because household liquid fuel combustion apparatus for use with kerosene generally have the heat outputs listed in Table 1 below.

TABLE 1

| Apparatus | Heat output |
|---|---|
| Space heater | 2,000-10,000 Kcal/h |
| Fan-forced heater | 1,000-3,000 |
| Range | 500-2,000 |
| Portable range | Up to 1,000 |

Liquid fuel combustion apparatus for use with kerosene must have constant flow rate characteristics because the operating point of the pump shifts to result in variations in the flow rate, i.e. in the state of combustion, due to the influence of the back pressure of the burner in the combustion chamber or to variations in the viscosity of kerosene caused by changes in temperature. It is desired that the pump have characteristics less susceptible to the influence of load variations.

Table 2 shows the characteristics of the pump determined by varying dimensions of the pump and parameters relating to the pumping spiral grooves 14.

TABLE 2

| | | Variations in characteristics when the parameter is large | |
|---|---|---|---|
| Parameter | | Max. flow rate Qmax | Max. pressure Pmax |
| Clearance | $\Delta R$ | Almost unchanged | Small |
| Length of pumping grooved portion | Lp | Almost unchanged | Large |
| Diameter of shaft | D | Large | Large |
| Speed of rotation | N | Large | Large |
| Groove/ridge ratio | $B_G/B_R$ | Large | Almost unchanged |
| Depth of grooves | ho/h mm | Large | Large |
| Depth of grooves | ho/h mm | Large | Small |
| Spiral angle | $0° < \alpha_p < 7°$ | Large | Large |
| Spiral angle | $7° < \alpha_p < 45°$ | Large | Small |
| Spiral angle | $45° < \alpha_p < 90°$ | Small | Small |

The maximum flow rate Qmax is the rate when the outlet pressure of the pump, P, is zero. The maximum pressure Pmax is the pressure when the flow rate Q is zero with the outlet of the pump closed.

When Qmax is higher, the flow rate is available with a greater latitude. The higher the pressure Pmax, the less susceptible are the characteristics to the influence of load variations.

In the case of liquid fuel combustion apparatus for use with kerosene, the pressure Pmax should not be lower than 0.2 kg/cm$^2$ with the present embodiment in view of the fact that the pump is actually used at an operating point $P_N$ which is less than Pmax. Accordingly how to assure the desired flow rate without reducing the pressure is a critical structural point in the case of the present pump which is designed for the supply of kerosene.

Since kerosene has a very low viscosity, the fuel leaks in a large amount from a high-pressure portion to a low-pressure portion in the interior of the present pump. It has been found that the clearance ΔR very greatly influences the pump characteristics.

Usually JIS No. 1 kerosene is used for liquid fuel combustion apparatus for household uses. In the range of temperatures (−20° C. to 50° C.) at which household liquid fuel combustion apparatus will be used, the kerosene has a viscosity $\eta$ of 0.85 to 2 cst.

As the clearance ΔR decreases, the leakage decreases and the maximum pressure Pmax increases but the maximum flow rate Qmax remains almost unchanged. Thus the smaller the clearance ΔR, the less susceptible are the pump flow rate characteristics to variations of load and the better is the result achieved. However, there are great limitations in respect of the assembly of parts and machining accuracy in ensuring a uniform clearance ΔR for quantity production. The present invention has overcome this problem.

Summarized below are the results of research conducted for the embodiment on the parameters that will influence the pump characteristics.

The length $L_p$ of the spirally grooved pumping portion 14 produces little or no influence on the maximum flow rate Qmax of the pump, while if the Lp is larger, the leak from the fluid channel can be prevented effectively, so that the maximum pressure increases almost proportionally. However, the Lp is limited because the overall length L of the rotary shaft 1 to be incorporated into the product is limited. The actual length L of the rotary shaft 1 is the Lp plus the length Ls of the seal grooved portion 15. The entire length of the pump is the length L plus the dimension of the motor assembly (FIG. 4).

With an increase in the diameter of the shaft, D, both Pmax and Qmax increase nearly in proportion thereto, but the weight and dimensions of the product, the torque for driving the motor (especially for startup), etc. impose limitations on the shaft diameter.

It is preferred that the overall length L and the diameter D of the rotary shaft 1 be in the range of $D \times L < 10$ $cm^2$ if largest.

The rotary shaft 1 has a length L of 10 cm, while the pumping spiral grooves 14 are formed over a length Lp of 5 cm for the following reason.

The lower seal grooves 15 formed above the pumping spiral grooves 14 as shown in FIG. 2 are designed to prevent ingress of kerosene into the outer portion of the pump (into the motor). The seal grooves 15 must be so formed as to give a sufficient seal pressure in preparation for an emergency.

For example, when dust or the like in the kerosene blocks the fluid channel from the pump to the combustion chamber 25A, a maximum pressure (shut-off pressure Pmax) will build up at the outlet side. To prevent leakage of the fuel from the pump even in such an event, the seal pressure must be greater than the shut-off pressure Pmax. For the prevention of leakage, the parameters may be so determined that the pressure produced by the seal grooves 15 is sufficiently greater than that produced by the pumping spiral grooves 14.

When the spiral angle $\alpha s$ of the lower seal grooves 15 is about 10°, Lp is 5.0 cm and Ls is 3.0 cm if the safety factor $\mu$ is 1.5.

To be most inexpensive, the motor be of the a.c. induction type. When a four-pole induction motor, which is commercially advantageous, is used at a power source frequency f of 60 Hz, the speed of rotation, $\omega$, obtained is $120/4 \times 60 = 1800$ r.p.m. in which the number of the poles P is 4.

Further in view of the characteristics of the pump, there are limitations on the speed of rotation for the prevention of the following troubles.

(1) Deflective rotation due to unbalance.

(2) Wear and seizure of sliding parts.

The degree of deflective rotation (1) due to unbalance, et. increases in proportion to the second power of the speed of rotation. The troubles (2) occur when the pump is initiated into rotation without allowing kerosene to fully penetrate into the pump, for example, after the liquid fuel combustion apparatus has been left out of use for a long period of time. While the pump has not been properly lubricated with kerosene, the higher the speed of rotation, the greater is the likelihood that sliding parts will seize.

In practice, therefore, it is preferable to limit the speed of rotation, N, to about 1800–2000 r.p.m.

When the ratio between the width $B_R$ of the pump spiral grooves 14 and the ridge width $B_G$ thereof, namely $B_G/B_R$, is increased, the maximum flow rate Qmax increases, with the maximum pressure Pmax remaining unchanged. However, Qmax increases when $B_G/B_R$ is between 1 to 2, but remains almost unincreased when the $B_G/B_R$ is 4 to 5.

Pmax and Qmax are in a conflicting relation when the spiral angle $\alpha p$ of the pumping spiral grooves 14 is in the range of $7° < \alpha p < 45°$. If $\alpha p$ is approximately 45°, the flow rate becomes maximum. When $\alpha p$ is approximately 7°, the pressure becomes maximum.

Figure 6:
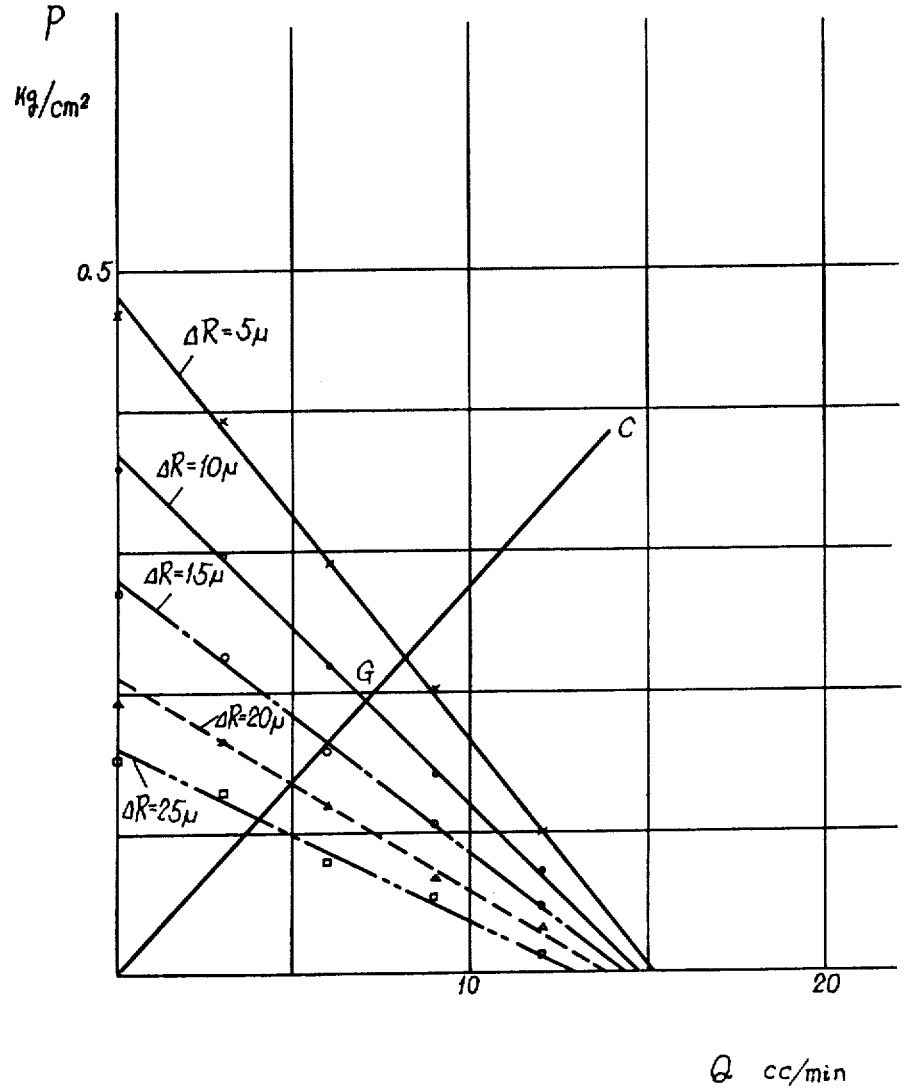
FIG. 6 is a diagram showing P–Q characteristics with use of ΔR as a parameter.

FIG. 6 shows the pressure-flow rate characteristics (PQ characteristics) of the pump with the parameters of Table 3 to illustrate some results of the reseach on the foregoing embodiment for quantity production. (groove depth $ho = 60\mu$)

TABLE 3

| Parameter | Symbol | Embodiment |
|---|---|---|
| Outside diameter of shaft | D | 1.0 cm ø |
| Length of pumping grooved portion 14 | Lp | 5.0 cm |
| Spiral angle | $\alpha p$ | 45° |
| Width of grooves | $B_G$ | 0.437 cm |
| Width of ridges | $B_R$ | 0.087 cm |
| Speed of rotation | N | 1800 r.p.m. |

Straight line C is a load line dependent on the flow resistance of the pipe 20 extending from the outlet bore 9 to the combustion chamber 25A. The intersection of the line and the PQ characteristics line, i.e. G, is the operating point.

FIG. 6 shows that with increasing clearance ΔR, the pressure Pmax decreases greatly although Qmax remains almost unchanged.

Figure 7:
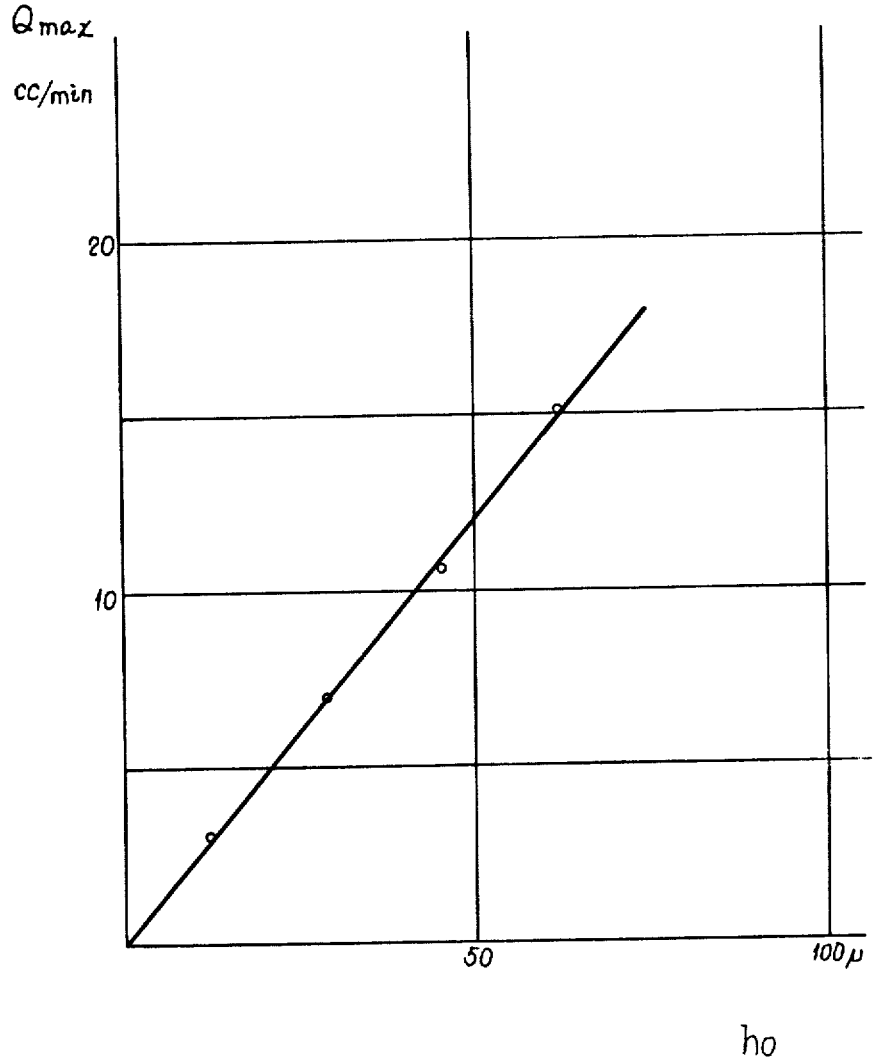
FIG. 7 is a characteristics diagram showing Qmax relative to ho.

FIG. 7 shows data of the maximum flow rate Qmax when the groove depth ho only is altered with use of the parameters of Table 3.

The actual flow rate Q is determined by the operating point G which is the intersection of the load line C and the PQ characteristics line. Q may be considered to be about ½ of Qmax usually.

For example, when Q = 7 cc/min is required, it is seen that $ho > 58\mu$ must be satisfied.

However, the upper limit value for the groove depth ho is greatly limited by the maximum pressure Pmax.

Figure 8:
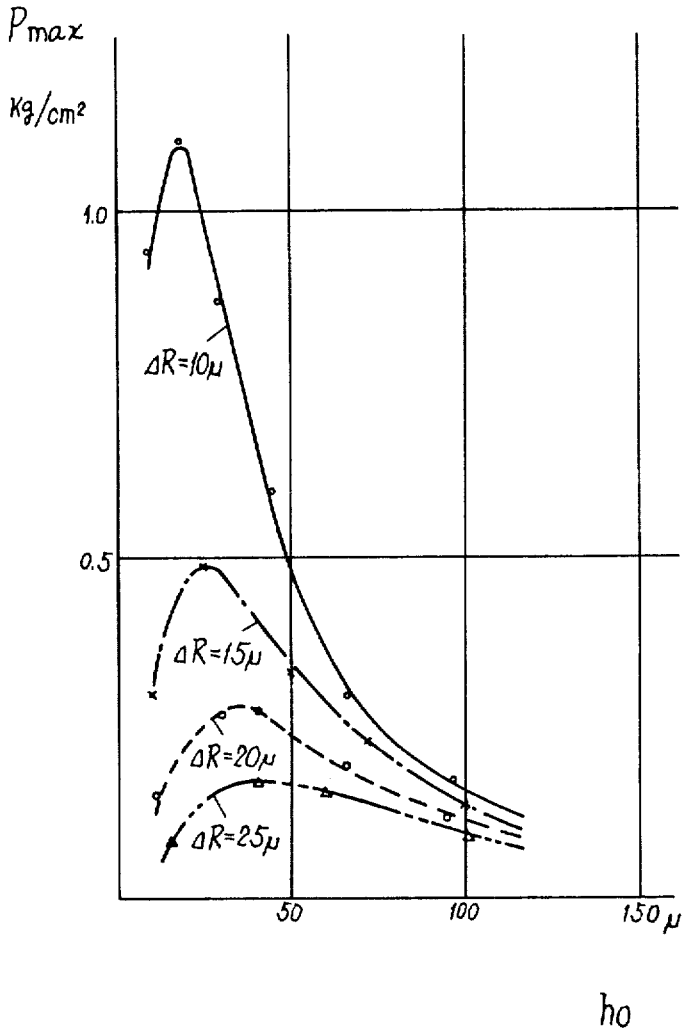
FIG. 8 is a characteristics diagram showing Pmax relative to ho with use of ΔR as a parameter.

FIG. 8 shows data substantiating this and revealing the maximum pressure Pmax relative to the groove depth ho as determined for the pump with the parameters of Table 3, using ΔR as a parameter.

FIG. 8 shows that when the groove depth ho is the same, the pressure Pmax increases with the decrease of the clearance ΔR.

To obtain Q=7 cc/min and Pmax>0.2 kg/cm$^2$, the clearance ΔR needs to be not larger than 20μ when ho is 58μ.

Briefly the above results of discussion indicate that the groove depth ho must be within the upper and lower limits to obtain the required flow rate and pressure and that the smaller the clearance ΔR, the better is the result.

According to the invention, the fluid to be pumped, i.e. kerosene, itself is used as a lubricating fluid to provide a fluid bearing and maintain a very small and uniform clearance ΔR during rotation. This has made it possible to produce a self-aligning action between the rotary shaft 1 and the housing 2 and obtain greatly improved pump characteristics.

With reference to FIG. 2, the rotary shaft 1 which is a rotating member rotates relative to the housing 2 which is a stationary member free of any contact except at the location of point contact where the pivot bearing 13 is provided.

When the rotary shaft 1 is brought out of alignment with the housing 2, a wedging oil film of kerosene affords a restoring force which acts to eliminate the misalignment, i.e. to maintain a uniform clearance ΔR circumferentially thereof.

Since the pivot bearing 13 is also in point contact and is not restrained radially of the rotary shaft 1, the bearing will not impede the aligning action.

The restoring force produced by the wedging oil film increases with the decrease of the clearance ΔR, giving an effective self-aligning action. The restoring force is in inverse proportion to the third power of the clearance ΔR. The range of the clearance ΔR that it is smaller than 20μ is appropriate usually in providing a fluid bearing. As already stated, the smaller the clearance ΔR, the more improved are the pump characteristics. This is an important feature of the invention.

The present device is easy to assemble and adjust because a uniform clearance ΔR can be formed automatically when the rotary shaft 1 is in rotation insofar as the shaft 1 and the housing 2 are made accurately.

Generally when the rotary shaft 1 is supported by a ball bearing, the axis will deflect owing to the undulation of the inner and outer races of the ball bearing, irregularities in the circularity of the balls, etc., producing a pronounced influence especially at locations away from the supporting point of the bearing. With the present construction, however, the rotary shaft 1 is entirely immersed in the lubricating fluid even when the shaft 1 has a large length, with the result that the restoring force of the fluid bearing afforded by the wedging oil film can be maintained uniformly longitudinally of the shaft.

Since the pump is mounted on the top of the kerosene tank 19A as shown in FIG. 5 according to the embodiment, there is the need to increase the overall length of the pump, but the pump has a simple construction and outstanding flow characteristics.

According to the embodiment, the bearing for supporting the rotor 3 of the motor is dispensed with, and the rotary shaft 1 integral with the rotor 3 has a supporting action in the thrust and radial directions. The rotary shaft 1 has a self-aligning action to produce a uniform clearance between the shaft and the housing 2. The rotor 3 may be supported by means other than the one shown in FIG. 2 for the embodiment, e.g. by a ball bearing. A movable bush having flexible freedom in the radial direction may be used in combination with a rotary shaft coupled to a motor shaft. In such a case, the rotary shaft 1 will not move radially either during rotation or while at a stop, but the movable bush assures automatic alignment to maintain a uniform clearance.

With the above arrangement, the drive source corresponding to the motor may be disposed outside the pump. For example, the motor shaft of a fan may be utilized.

Given below are the features of the present invention which utilizes the pumping action of a pattern of shallow grooves, such as the pumping spiral grooves 14, for providing a liquid fuel supply pump. (1) A pump is obtained which is capable of controlling the amount of combustion continuously from large to small.

Figure 9:
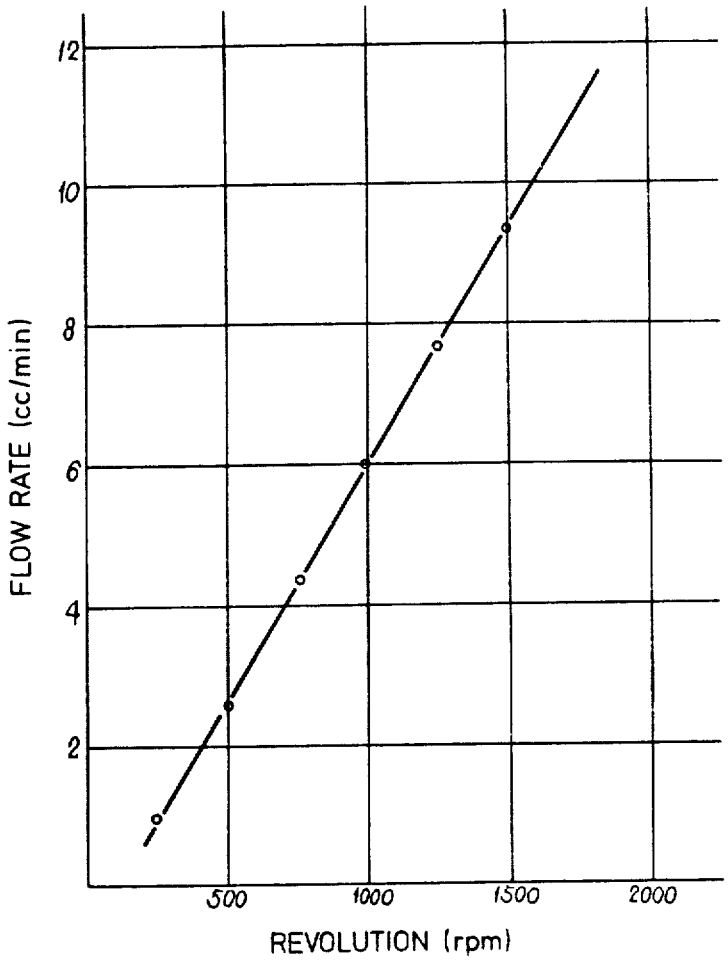
FIG. 9 is a diagram showing flow rate characteristics relative to speed of rotation.

FIG. 9 shows the pump flow rate relative to the speed of rotation of the motor as determined when the pumping spiral grooves 14 have the parameters of Table 4.

TABLE 4

| Parameter | Symbol | Embodiment |
|---|---|---|
| Outside diameter of shaft | D | 0.8 cm |
| Length of pumping grooved portion 14 | LP | 5.0 cm |
| Spiral angle | α | 45° |
| Width of grooves | $B_g$ | 0.377 cm |
| Width of ridges | $B_R$ | 0.126 |
| Clearance | ΔR | 20μ |
| Depth of grooves | ho | 60μ |

The measurements reveal that the flow rate is proportional to the speed of rotation even when the flow rate is below 5 cc/min which is the lower limit for the conventional plunger pump of FIG. 1 and further that the flow rate varies linearly with the speed of rotation, indicating that the amount of combustion is continuously controllable over a wider range by varying the speed of rotation.

(2) Variations in pressure and flow rate are small.

Figure 10:
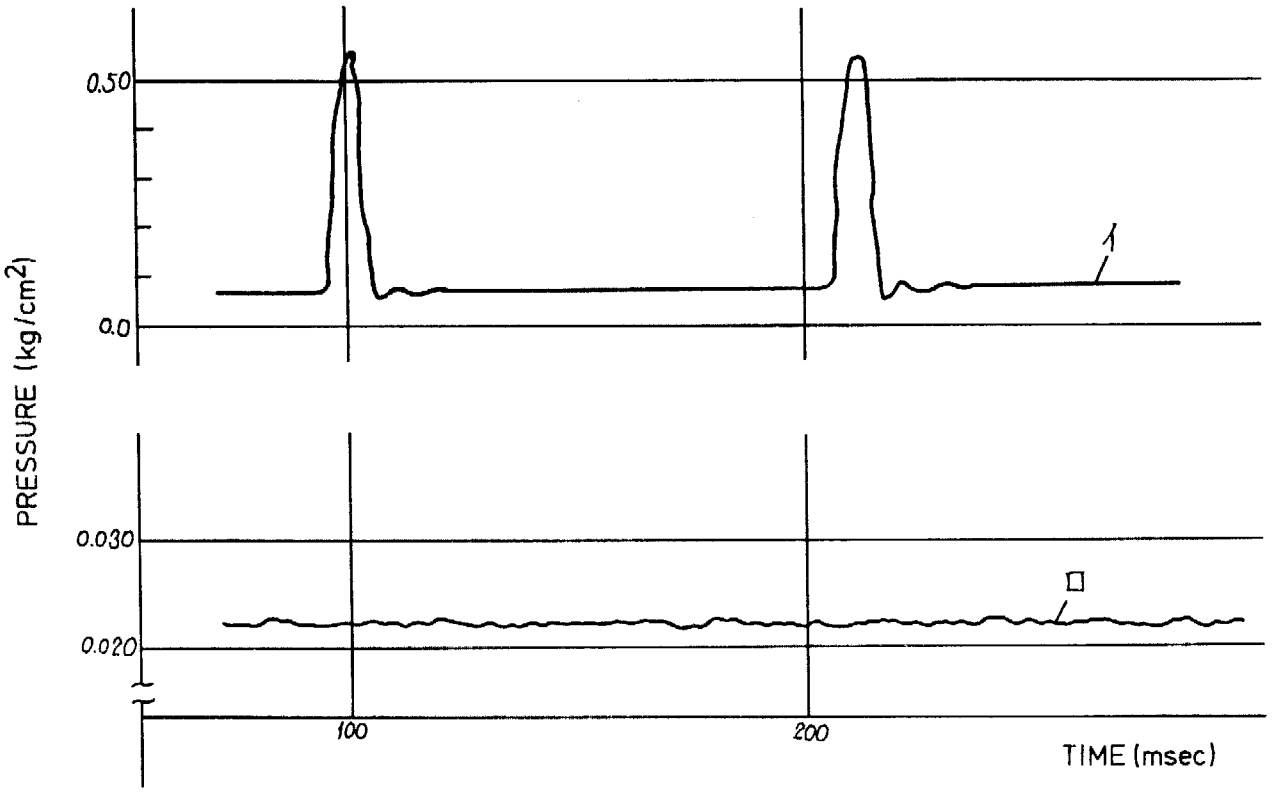
FIG. 10 is a diagram showing the pressure variation characteristics of the conventional liquid fuel supply pump shown in FIG. 1 and the liquid fuel supply pump embodying the invention and shown in FIG. 2.

FIG. 10 shows the pressure variation characteristics of the conventional plunger pump and the pump of the invention as determined for comparison. It is seen that the pressure characteristics τ of the conventional pump involves great pressure variations attributable to the modulated frequency (f=9 Hz), whereas the characteristics □ of the present pump involve very slight variations.

These measurements are determined when the load resistance at the outlet side is 0.

The pressure variations ΔP of the plunger pump is about 0.5 kg/cm$^2$, whereas that of the present pump detectable is about 0.01 kg/cm$^2$, which is 1/50 of the former value.

Accordingly the present pump does not require the use of a tank for eliminating flow variations, U-shaped tube leveller or the like employed for conventional plunger pumps but can be connected directly to the liquid fuel combustion apparatus for the supply of kerosene 17 as shown in FIG. 5.

Figure 1:
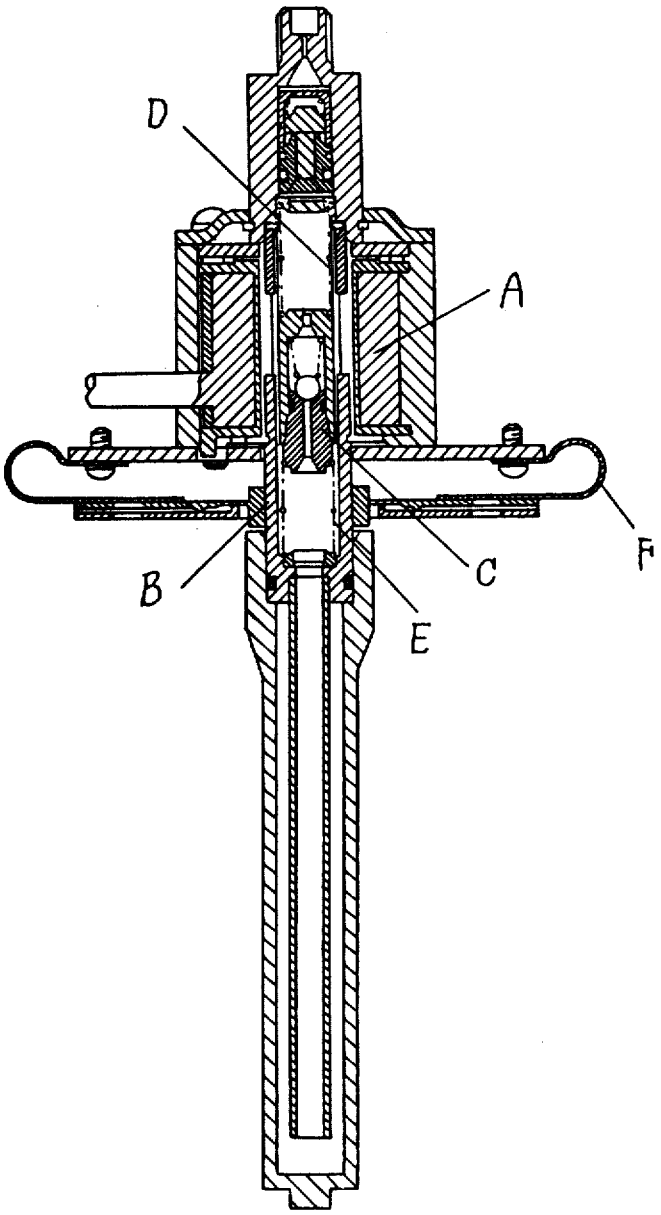
Fig. 1 PRIOR ART
FIG. 1 is a sectional view showing a liquid fuel supply pump generally used conventionally.

The pump of this invention having the foregoing features in characteristics is exceedingly simpler in construction and can therefore be built at a lower cost than the conventional plunger pump (FIG. 1).

A comparison of FIG. 1 with FIG. 2 reveals a great reduction in the number of parts as listed in Table 5.

TABLE 5

| | Conventional plunger pump | Present pump |
|---|---|---|
| Number of main parts | 16 | 6 |

For example, the present pump does not require a damper, etc. needed for the conventional pump to eliminate intermittent vibration and noise as will be apparent from the principle of its operation.

Figure 11:
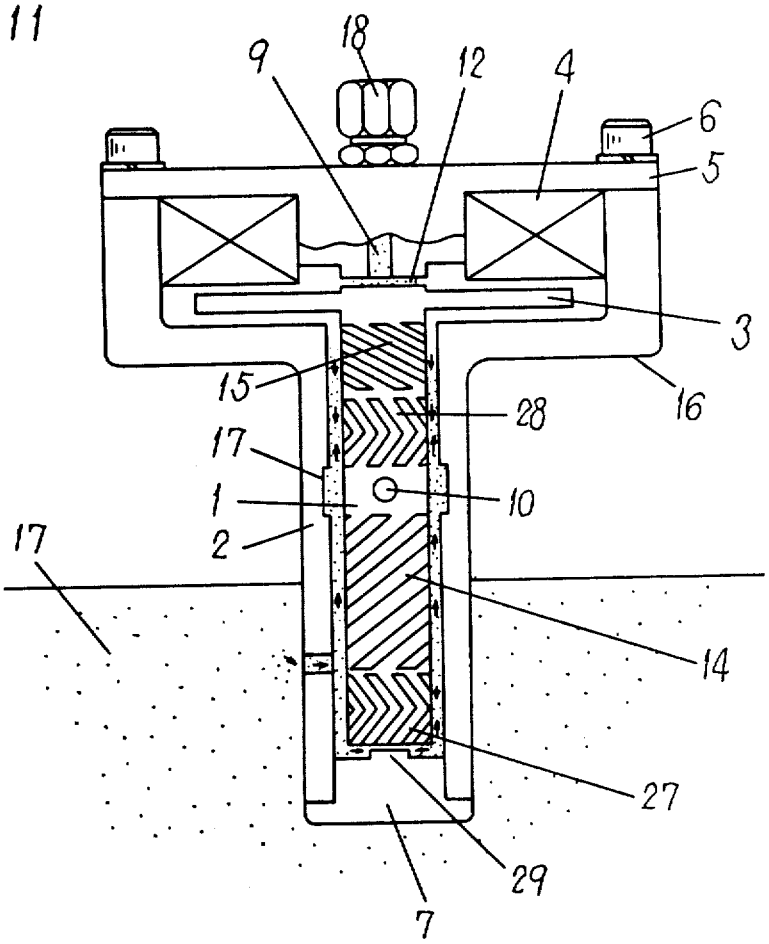
FIG. 11 is a sectional view showing a liquid fuel supply pump according to another embodiment of the invention.

FIG. 11 shows another embodiment of the present invention which includes, in addition to the pumping spiral grooves 14 and the lower seal grooves 15, herringbone grooves 27, 28 for providing fluid bearings which enable a wedging oil film to produce a greatly improved automatic aligning action. Stated more specifically, when a fluid bearing is formed with use of an accurately circular shaft for providing between relatively moving surfaces a clearance which is uniform circumferentially thereof, an oil whirl occurs which is an unstable phenomenon unique to the fluid bearing. The oil whirl refers to the phenomenon of deflections with a period ½ the driving rotation. The phenomenon makes it impossible to maintain a uniform clearance $\Delta R$, consequently giving rise to variations in the pump flow rate Q.

The deflection is likely to cause metal-to-metal contact between the surfaces in relative sliding movement. The wear then resulting from a long period of use increases the clearance $\Delta R$ to reduce the flow rate of the pump. When the pump is so constructed as already described with reference to FIG. 2, the pumping spiral grooves 14 and the lower seal grooves 15 act to provide noncircular bearings which are effective for preventing the deflection due to the oil whirl.

The embodiment of FIG. 11 has the fluid bearings afforded by the herringbone grooves 27, 28 for preventing the oil whirl more effectively, in addition to the oil whirl preventing effect given by the pumping spiral grooves 14 and lower seal grooves 15. Table 6 shows the parameter values of the embodiment of FIG. 11.

TABLE 6

| Parameter | Symbol | Embodiment |
|---|---|---|
| Outside diameter of shaft | D | 1.0 cm ø |
| Length of spiral groove fluid bearing | $L_B$ | 0.8 cm |
| Spiral angle | $\alpha$ | 30° |
| Groove/ridge width ratio | $B_G/B_R$ | 1 |
| Groove depth | ho | 15μ |

Satisfactory results are achieved by the embodiment when ho is in the range of 5μ to 30μ.

When the pumping spiral grooves 14 have a larger groove depth ho, a higher flow rate Q is obtained, so that when a pump having a relatively high flow rate Q is to be made according to the invention, the pumping spiral grooves 14 and the herringbone grooves 27, 28 may be made by separate steps.

With the present embodiment, the herringbone grooves 27 are formed in a lower end portion of the rotary shaft 1 to be immersed in kerosene 17, and the herringbone grooves 28 are formed in the intermediate portion between the lower seal grooves 15 and the port 10. The pumping spiral grooves 14 produce an increased pressure in the vicinity of the port 10, permitting the kerosene 17 to effectively rise to the level of the grooves 15 where relative sliding motion is involved. Accordingly both the herringbone grooves 27, 28 can be fully exposed over the sliding surfaces to the kerosene 17 serving as a lubricant. This assures appropriate fluid lubrication.

Figure 12:
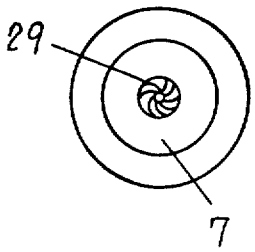
FIG. 12 is a plan view of a rotor in FIG. 11.

Although the pivot bearing 13 is used in the embodiment of FIG. 2 as a thrust support at the lower portion of the rotary shaft 1, the embodiment of FIG. 11 and FIG. 12 has at the lower end of the rotary shaft 1 spiral grooves 29 for forming a bearing.

Although the rotary shaft 1 of the embodiments of FIG. 2 and FIG. 11 has the pumping spiral grooves 14 and is rotatable, the housing 2 for accommodating the rotary shaft 1 may be formed with the pumping spiral grooves 14 on the inner surface thereof.

The rotary shaft 1 may be made stationary, and the housing 2 rotatable.

While the embodiments of FIG. 2 and FIG. 11 include an induction motor with components arranged face-to-face, the motor may be one comprising radially opposed components.

The internally incorporated motor used as the drive means may be replaced by an external motor.

The rotary shaft 1 may have a tapered shape and be accommodated in a similarly tapered housing 2.

In this case, the average diameter of the taper may be taken as the shaft diameter D mentioned herein.

The groove depth, shaft diameter, spiral angle, groove/ridge ratio, etc. herein referred to need not be uniform throughout the entire shape concerned; the average values may be considered in the application of the discussed items herein.

The port 9 need not extend through the rotary shaft 1 but may be formed, for example, in the housing 2 of FIG. 2 in the vicinity of the upper end of the pumping spiral grooved portion 14.

INDUSTRIAL APPLICABILITY

As described above, the present invention provides a kerosene supply pump which has a pattern of shallow grooves between a stationary member and a movable member on one surface thereof movable relative to the other and which possesses features unavailable with conventional plunger pumps.

The liquid fuel combustion apparatus equipped with the present pump has the features summarized below.

(1) The amount of combustion is controllable over a wider range to assure efficient and clean combustion.

(2) Reduced variations in pressure and flow rate ensure stabilized combustion.

(3) Kerosene can be supplied at an exceedingly small rate to sustain a slow fire which is infeasible with plunger pumps.

(4) Freedom from vibration and noise.

(5) Simple and inexpensive construction.

The present pump serves as a pump for supplying kerosene, fuel oil or like fuel and finds wide use for water heaters, water boilers, fan heaters, ranges, boiling devices, etc.

We claim:

1. A pump for supplying liquid fuel comprising:

housing means (2, 5, 7) provided therein with a fuel-passage and having an inlet (8) and an outlet (9);

rotor means (1, 3) entirely accomodated within said housing means (2, 5, 7) without any mechanical radial supporting connection therebetween and comprising a shaft (1) disposed in said passage of said housing means (2, 5, 7); said shaft and said passage having radially opposed surfaces with a specified clearance (ΔR) formed therebetween when said rotor means is in rotation, said clearance (ΔR) being not larger than 20 microns;

stator means (4) carried by said housing means (2, 5, 7) for electromagnetically rotating said rotor means (1, 3) relative to said housing means (2, 5, 7);

pumping groove means (14) formed in one of said radially opposed surfaces of said shaft (1) and said passage for forcing the fuel along said groove means (14) by the rotation of said shaft (1) and for forming a fluid bearing by the fuel in said clearance (ΔR) between the shaft surface and the passage surface;

said rotor means (1, 3) comprising in addition to said shaft (1), a disc (3) provided at one end of said shaft (1) in opposed relation to said stator means (4); and herringbone groove means (27, 28) formed on said one surface carrying said pumping groove means (14) for providing fluid bearings said herringbone groove means being formed on a part or parts of said one surface not formed with said pumping groove means.

2. A pump as defined in claim 1 wherein said pumping groove means comprises helical groove means (14) formed in the shaft surface at or close to the other end thereof, a port (10) communicating with said inlet (8) of the housing means (2, 5, 7) is formed in said shaft (1) intermediate said pumping helical groove means (14) and said disc (3), and an axial channel (11) is provided in said shaft (1) at said one end thereof and communicating with said port and said outlet (9) of the housing means (2, 5, 7).

3. A pump as defined in claim 2 wherein a larger inner diameter portion (17A) surrounding said port (10) is formed in the passage surface.

4. A pump as defined in claim 2 wherein sealing helical groove means (15) having a helix reverse to the helix of the pumping helical groove means (14) is formed in the shaft surface between said port (10) and said disc (3).

5. A pump as defined in claim 4 wherein said herringbone groove means comprises herringbone grooves (28) formed in the shaft surface between said port (10) and said helical groove means (15).

6. A pump as defined in claim 2 wherein spiral grooves (12) extending radially outward from said axial channel (11) of said shaft (1) are provided in one side surface of said disc (3) remote from said other end of said shaft (1) for forming a fluid thrust bearing against said housing means (2, 5, 7) by the fuel.

7. A pump as defined in claim 2 wherein a spherical pivot bearing (13) is provided between the end face of said shaft (1) at said other end thereof and the housing means (2, 5, 7).

8. A pump as defined in claim 2 wherein axially opposed surfaces are provided by an end face of said shaft and an inner surface of said housing means adjacent to said end face, and radially extending spiral groove means (12, 29) for forming a fluid thrust bearing are provided in one of said axially opposed surfaces.

9. A pump as defined in claim 1 wherein said herringbone groove means comprises herringbone grooves (27) formed in the shaft surface at said other end thereof.

10. A pump as defined in claim 1 wherein said herringbone groove means comprises herringbone grooves (28) formed in the shaft surface between said port (10) and said disc (3).

* * * * *